United States Patent [19]

Hayne

[11] 3,944,356

[45] Mar. 16, 1976

[54] CHARGING APPARATUS

[75] Inventor: Thomas F. Hayne, Fairport, N.Y.

[73] Assignee: Xerox Corporation, Stamford, Conn.

[22] Filed: Aug. 29, 1974

[21] Appl. No.: 501,543

[52] U.S. Cl. ..... 355/3 R; 355/4; 355/14; 355/17

[51] Int. Cl.[2] ..... G03G 15/00

[58] Field of Search ..... 355/3 R, 14, 17, 4

[56] References Cited

UNITED STATES PATENTS 3,352,218 11/1967 Ostensen ..... 355/14 X 3,503,677 3/1970 Uchiyama ..... 355/14 X

*Primary Examiner*—Monroe H. Hayes

*Attorney, Agent, or Firm*—H. Fleischer; J. J. Ralabate; C. A. Green

[57] ABSTRACT

An apparatus adapted to charge an image bearing member to a substantially uniform potential. The apparatus controls the area of the surface charged on the image bearing member so that it corresponds substantially in size to that of a sheet of support material arranged to have a copy of an original document reproduced thereon.

19 Claims, 4 Drawing Figures

CHARGING APPARATUS

BACKGROUND OF THE INVENTION

This invention relates generally to an electrophotographic printing machine, and more particularly concerns an apparatus which is regulated to produce a charged surface area on a photoconductive member corresponding in size substantially to that of a sheet of support material arranged to have a copy of an original document reproduced thereon.

A typical electrophotographic printing machine includes a photosensitive surface which is electrostatically charged substantially uniformly thereover. A light image of the original document being reproduced irradiates the charged photosensitive surface. This light image discharges the electrostatic charge in the irradiated areas of the photosensitive surface. As a consequence thereof, the remaining charge on the photosensitive surface forms an electrostatic charge pattern in image configuration, i.e. an electrostatic latent image. The electrostatic latent image is then developed by contacting it with finely divided electrostatically attractable material, i.e. toner particles. The toner particles adhere electrostatically to the photosensitive surface in a pattern corresponding to that of the latent image recorded thereon. Thereafter, the developed image is transferred to the sheet of support material, e.g. paper or any other suitable material, such as a thermoplastic sheet. The powder image transferred to the sheet of support material is subsequently permanently affixed thereto forming a permanent print of the original document thereon. This process is more thoroughly described in U.S. Pat. No. 2,297,691 issued to Carlson in 1942.

Multi-color electrophotographic printing is similar to the heretofore discussed process. However, each image in the multi-color electrophotographic printing process represents a partial single color image which corresponds to one color of the original document. Thus, a multi-color process requires the utilization of a plurality of single color images each adapted to be reproduced with its correspondingly complementarily colored toner particles. Accordingly, a color reproduction requires a plurality of differently colored toner powder images which are superimposed onto the sheet of support material in registration with one another, thereby forming a color copy. The formation of the color copy from a colored original document requires substantially more toner particles than is employed in the creation of black and white copies. This substantially increases the risk of contaminating various machine components with toner particles.

A uniform charge potential is applied to the photoconductive surface by a corona generating device. Various types of corona generating devices may be used in electrophotographic printing. For example, U.S. Pat. No. 2,836,725 issued to Vyverberg in 1958 and U.S. Pat. No. 2,778,946 issued to Mayo in 1957 disclose suitable corona generating devices for use in electrophotographic printing. However, regardless of the type of corona generating apparatus employed, all of the heretofore utilized devices are energized continuously and charge the entire surface of the photoconductive member. This results in the non-image areas being developed with toner particles. These toner particles must be subsequently cleaned from the photosensitive surface and introduce the additional risk of contamination.

In order to alleviate this problem some machines employ inter-image erase lamps. An inter-image erase lamp discharges the photoconductive surface in the non-image regions This prevents the subsequent development of the non-image regions and reduces the waste and contamination resulting from the deposition of toner particles in these areas. The employment of an inter-image erase lamp introduces an added complexity to the electrophotographic printing machine. Inter-image erase lamps generally comprise an electroluminescent panel which must be periodically excited by the machine logic to discharge only the selected region of the photoconductive surface, i.e. the non-image region.

Other prior art devices have been employed wherein a photoconductive copy sheet is employed to actuate a high intensity lamp and a corona generating unit. In this type of an apparatus the leading edge of the copy sheet actuates the high intensity lamp and corona generating unit. Thereafter, the trailing edge of the copy sheet de-energizes the foregoing assemblies. One example of this type of apparatus is disclosed in U.S. Pat. No. 3,700,327 issued to Murgas in 1972. Other patents which disclose various techniques for controlling the corona generating apparatus are U.S. Pat. No. 2,890,343 issued to Bolton in 1959, U.S. Pat. No. 3,335,273 issued to Walkup in 1967 U.S. Pat. No. 3,791,732 issued to Mihalik et al in 1974, and U.S. Pat. No. 3,444,354 issued to Mindell in 1969. However, none of the foregoing prior art patents appear to discuss the problem associated with continuously charging the photoconductive member.

Accordingly, it is a primary object of the present invention to improve the corona generating apparatus so that the size of the area charged on the photoconductive surface conforms substantially to that of the support sheet having the copy of the original document being reproduced thereon.

SUMMARY OF THE INVENTION

Briefly stated, and in accordance with the present invention, there is provided an apparatus for forming a charged area on an image bearing member.

Pursuant to the features of the present invention, the charged area on the image bearing member corresponds substantially in size to that of a sheet of support material arranged to have a copy of an original document reproduced thereon. This is achieved, in the present instance, by detecting means, charging means and controlling means. Detecting means sense the size of the surface area of the sheet of support material. Charging means charge the image bearing member to a substantially uniform potential. Controlling means, responsive to the detecting means, regulate the charging means. In this manner, the charged surface area of the image bearing member corresponds substantially in size to the surface area of the sheet of support material.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
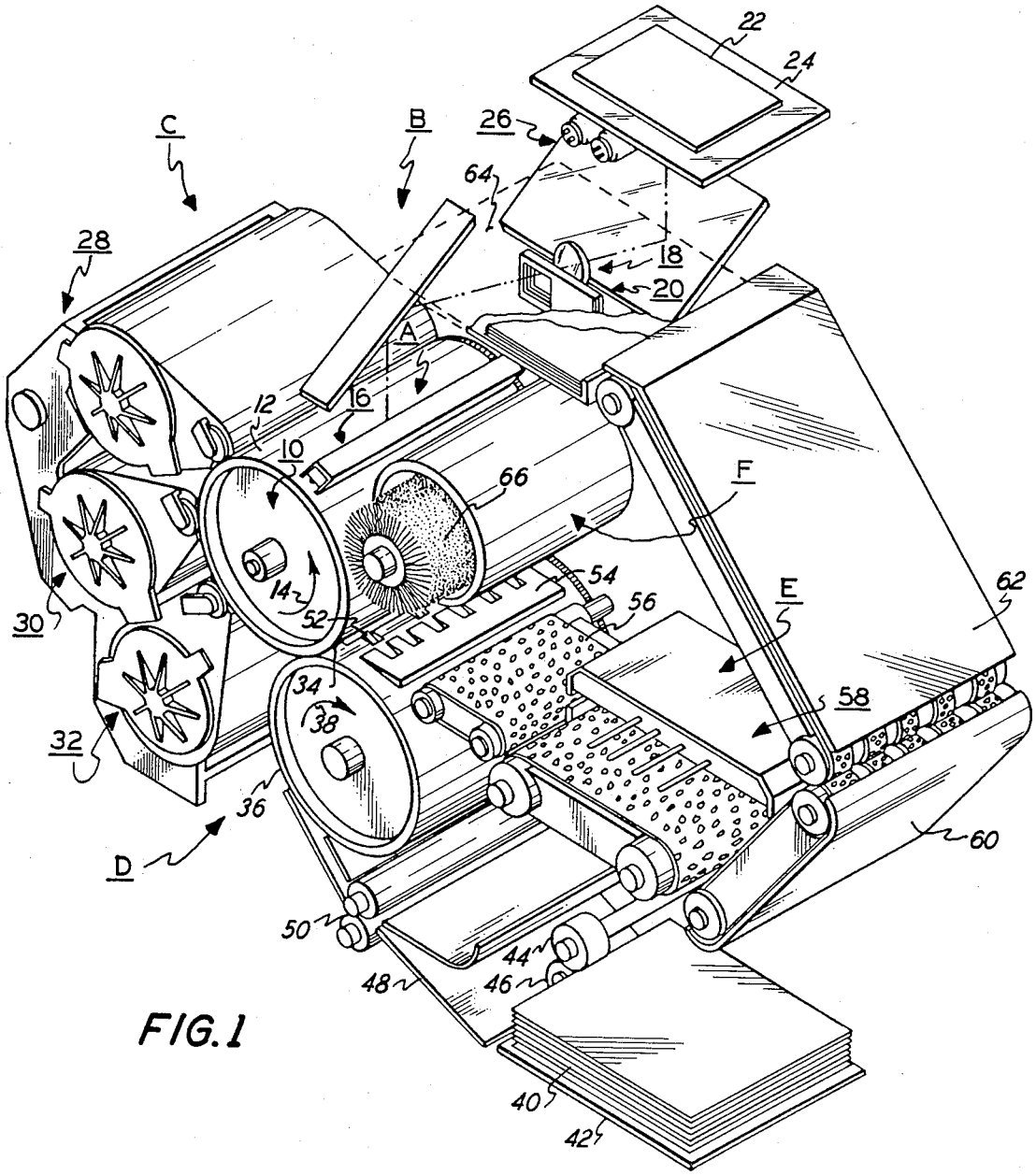
FIG. 1 is a schematic perspective view depicting an electrophotographic printing machine employing the features of the present invention therein.

For a general understanding of the disclosed electrophotographic printing machine in which the present invention may be incorporated, continued reference is had to the drawings, wherein like reference numerals have been used throughout to designate like elements. FIG. 1 schematically illustrates the various components of an electrophotographic printing machine arranged to produce color copies. The foregoing electrophotographic printing machine is only one type of an electrophotographic printing machine which may incorporate the features of the present invention therein and is merely described herein as an illustrative embodiment thereof. Although the apparatus of the present invention is particularly well adapted for use in an electrophotographic printing machine, it should become evident from the following discussion that it is equally well suited for use in a wide variety of machines and is not necessarily limited to the particular embodiment shown herein.

Referring now to FIG. 1, there is shown a printing machine employing an image bearing member which comprises a photoconductive member having a drum 10 mounted rotatably on a shaft (not shown) of the printing machine. Photoconductive surface 12 is entrained about and secured to drum 10. As drum 10 rotates in the direction of arrow 14, photoconductive surface 12 passes sequentially through a series of processing stations. A timing disc (not shown) is positioned in the region of one end of the shaft supporting drum 10. The timing disc is opaque with a plurality of slits spaced about the periphery thereof. A light source and photosensor are mounted stationarily on the machine frame with the disc interposed therebetween. As the disc rotates, light rays are transmitted through the slits. These light rays activate the photosensor to produce electrical pulses. The electrical pulses from the photosensor are processed by suitable circuitry and the output therefrom is employed to activate the various processing stations disposed about the periphery of drum 10. These processing stations are activated sequentially so as to produce the proper events at the appropriate time. In particular, these electrical pulses activate the control circuitry of charging station A. A detailed discussion of the control circuitry and charging apparatus of the present invention will be discussed with reference to FIGS. 2 through 4, inclusive.

As drum 10 rotates, it initially moves photoconductive surface 12 through charging station A. The charging apparatus of the present invention, indicated generally as 16, is positioned at charging station A. Charging apparatus 16 extends in a generally transverse direction across photoconductive surface 12. This enables charging apparatus 16 to charge photoconductive surface 12 to a relatively high substantially uniform potential. Charging apparatus 16 and the operation thereof will be described hereinafter, in greater detail, with reference to FIGS. 2 through 4, inclusive.

Continuing now with the description of the various processing stations through which photoconductive surface 12 passes. After charging, drum 10 rotates the photoconductive surface 12 to exposure station B. At exposure station B, a color filtered light image of the original document is projected onto charged photoconductive surface 12. Preferably, exposure station B includes a moving lens system, generally designated by the reference 18 and a color filter mechanism shown generally at 20. A suitable moving lens system is described in U.S. Pat. No. 3,062,108 issued to Mayo in 1962. Similarly, a suitable filter mechanism is described in U.S. Pat. No. 3,775,006 issued to Hartman in 1973. Finally, a suitable lens is described in U.S. Pat. No. 3,592,531, issued to McCrobie in 1971. As shown in FIG. 1, an original document 22, such as a sheet, book or the like is positioned face down on transparent viewing platen 24. Lamp assembly 26, lens system 18 and filter mechanism 20 move in a timed relation relative to drum 10 scanning successive incremental areas of original document 22 disposed upon platen 24. This enables the flowing light image of original document 22 to be projected onto charged photoconductive surface 12. During exposure, filter mechanism 20 interposes selected color filters into the optical light path. The color filter operates on the light rays to produce a single color light image which records an electrostatic latent image on photoconductive surface 12 corresponding to a preselected spectral region of the electromagnetic wave spectrum, hereinafter referred to as a single color electrostatic latent image.

Thereafter, drum 10 rotates photoconductive surface 12, with the single color electrostatic latent image recorded thereon, to development station C. Development station C includes three individual developer units, generally designated by the reference numerals 28, 30 and 32, respectively. Preferably, the developer units are all of a magnetic brush type. A typical magnetic brush system employs a magnetized developer mix of carrier granules and toner particles. The developer mix is continually brought through a directional flux field to form a brush thereof. As drum 10 rotates, photoconductive surface 12 passes through the brush of developer mix and the electrostatic latent image recorded thereon contacts the developer mix. Each of the respective developer units 28, 30 and 32, contain discretely colored toner particles corresponding to the complement of the spectral region of the wave length of light transmitted through filter 20. For example, a green filtered electrostatic latent image is rendered visible by depositing green absorbing magenta toner particles thereon. Blue and red latent images are developed with yellow and cyan toner particles, respectively. A suitable development station utilizing a plurality of such developer units is described in co-pending application Ser. No. 255,259, filed in 1972.

After the electrostatic image recorded on photoconductive surface 12 is developed, drum 10 rotates to transfer station D. At transfer station D, the toner powder image adhering electrostatically to photoconductive surface 12 is transferred to a sheet of support material 34. Support material 34 may be, amongst others, plain paper or a sheet of thermoplastic material. Sheet 34 is secured releasably to a transfer roll, shown generally at 36. As indicated in FIG. 1, transfer roll 36 rotates in the direction of arrow 38 to move support material 34 therewith in a recirculating path. Transfer roll 36 is electrically biased to a sufficient magnitude and the proper polarity to attract toner particles from the electrostatic latent image recorded on photoconductive surface 12 to support material 34. A suitable electrically biased transfer roll is described in U.S. Pat. No. 3,612,677 issued to Langdon, et al in 1971. Transfer roll 36 rotates in synchronism with drum 10 (in this case at substantially the same angular velocity therewith). Inasmuch as support 34 is secured releasably thereon for movement in a recirculating path therewith, successive toner powder images may be transferred from photoconductive surface 12 to support material 34, in superimposed registration with one another.

Prior to proceeding with a description of the remaining processing stations through which photoconductive surface 12 rotates, a brief description will be provided of the sheet feeding apparatus. It should be noted that length of paper or stack 40 disposed upon tray 42 is variable. Different lengths of stack 40 will activate differing switches located on tray 42 (FIG. 3) so as to energize the corona generating device apparatus of the present invention for the appropriate time increment. Support material 34 is advanced from stack 40. Stack 40, as hereinbefore mentioned, is disposed upon tray 42. Feed roll 44 in operative communication with retard roll 46 advances and separates the uppermost sheet from stack 40. The advancing sheet moves into chute 48 which directs the sheet between the nip of register rolls 50. Register rolls 50 align the advancing sheet. Thereafter, gripper fingers 52, mounted on transfer roll 36 secure releasably thereto support material 34 for movement therewith in a recirculating path.

After a plurality of toner powder images have been transferred to support material 34, gripper fingers 52 space support material 34 from transfer roll 36. Stripper bar 54 is then interposed between transfer roll 36 and support material 34 to separate support material 34 therefrom. Support material 34 is, thereafter, advanced on endless belt conveyor 56 to fixing station E.

At fixing station E, a suitable fuser indicated generally at 58, applies efficient heat to the toner powder images transferred to support material 34 so as to permanently affix them thereto. A suitable fuser is described in U.S. Pat. No. 3,498,592 issued to Moser, et al in 1970. After the fixing process, support material 34 is advanced by endless belt conveyors 60 and 62 to catch tray 64 for subsequent removal therefrom by the machine operator.

Invariably, some residual toner particles remain on photoconductive surface 12 after the transfer of the powder image to support material 34. These residual toner particles are removed from photoconductive surface 12 as it passes through cleaning station F. At cleaning station F, a corona generating device (not shown) neutralizes the charge on the residual toner particles and photoconductive surface 12. Brush 66, in contact with photoconductive surface, removes the residual toner particles. A suitable brush cleaning device is described in U.S. Pat. No. 3,590,412 issued to Gerbasi in 1971.

It is believed that the foregoing description is sufficient for purposes of the present application to illustrate the general operation of a multi-color electrophotographic printing machine embodying the teachings of the present invention therein.

Figure 2:
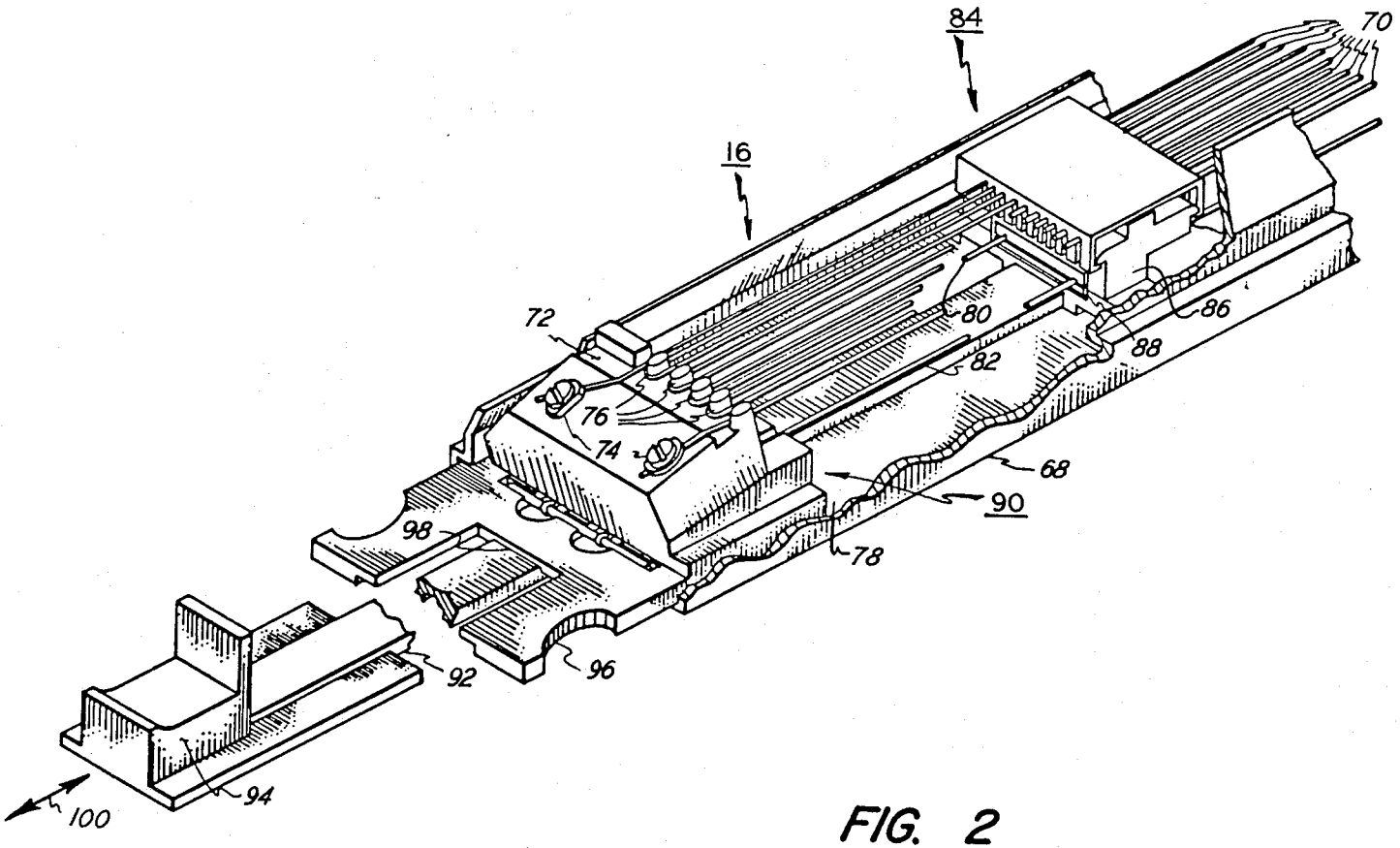
FIG. 2 is a perspective view of a corona generating apparatus used in the FIG. 1 printing machine.

Referring now to the specific subject matter of the present invention, FIG. 2 depicts corona generating apparatus 16 in detail. Preferably, corona generating apparatus 16 includes an elongated conductive shield 68 defining an open ended chamber opposed from photoconductive surface 12. Shield 68 is a U-shaped conductive housing which is preferably made from an aluminum extrusion. A plurality of substantially parallel spaced, fine conducting grid wires 70 (in this case 10) extend in a longitudinal direction from one end of shield 68 to the other end thereof and across about ¾ of the open end of the chamber therein. An insulating plate 72 is affixed permanently to either end of shield 68 by suitable means (not shown), e.g., fasteners or an adhesive. Grid wires 70 are preferably formed from a single wire attached to fasteners 74 and entrained about uprights 76 on insulating plate 72. Interposed between grid wire 70 and back wall 78 of shield 68 is a pair of coronode wires 80 and 82, respectively. Coronode wires 80 and 82 are suitably secured to insulating plate 76, preferably by fasteners (not shown). Both grid wires 70 and coronode wires 80 and 82, respectively, are preferably made from a conductive material, for example, platinum. Insulating plate 72 is, preferably, made from a dielectric material such as a glass alkyd, lucite, plexy-glass, and the like. As depicted in FIG. 2, coronode wire 80 is positioned in the portion of the chamber of shield 68 that is not covered by grid wires 70, i.e., grid wires 70 do not extend over this portion of the open end of shield 68. As previously mentioned, grid wires 70 extend only across about ¾ of the open end of shield 68. This permits rapid and roughly controlled charging of photoconductive surface 12 in the lead section or the portion of shield 68 not covered by grid wires 70. Slow and well controlled charging is obtained over the trailing section or the portion of shield 68 covered by grid wire 70. A suitable high voltage source (FIG. 4) excites coronode wires 80 and 82 to a voltage preferably ranging from about 6000 volts to about 8000 volts, the coronode wire current ranging from about 200 to 500 micro-amperes. A medium voltage source (FIG. 4) excites grid wires 72, preferably to about 925 volts.

In order to reduce the sensitivity of corona generating apparatus 16 to dirt, cleaning device 84 is provided therein. Deposits of toner particles and dust collected on coronode wires 80 and 82, respectively, and grid wires 70 are removed by cleaning device 84. Cleaning device 84 includes a scraping member depicted generally by the reference numeral 86 and a wiping member depicted generally by reference numeral 88. A moving mechanism, indicated generally by the reference numeral 90, is associated with cleaning device 84. Moving mechanism 90 comprises an elongated rod 92 attached to cleaning device 84. Rod 92 extends through insulating plate 72 affixed to the end portions of shield 68. Preferably, rod 92 extends longitudinally through the center of shield 68. Handle 94 is attached to rod 92 and is external to one end portion of shield 68, in the region of insulating plate 72, permitting an operator to grasp handle 94 to reciprocate rod 92 and, in turn, move cleaning device 84. Block 96 is, preferably, integral with insulating plate 72 and affixed to one end portion of shield 68 with channel 98 therein adapted to receive elongated rod 92. Channel 98 is arranged to guide rod 92 in the longitudinal movement thereof. In this manner, cleaning device 84 is reciprocated, in the direction of arrow 100, along grid wires 70 and coronode wires 80 and 82, respectively, so as to remove contaminating particles adhering thereto.

Figure 3:
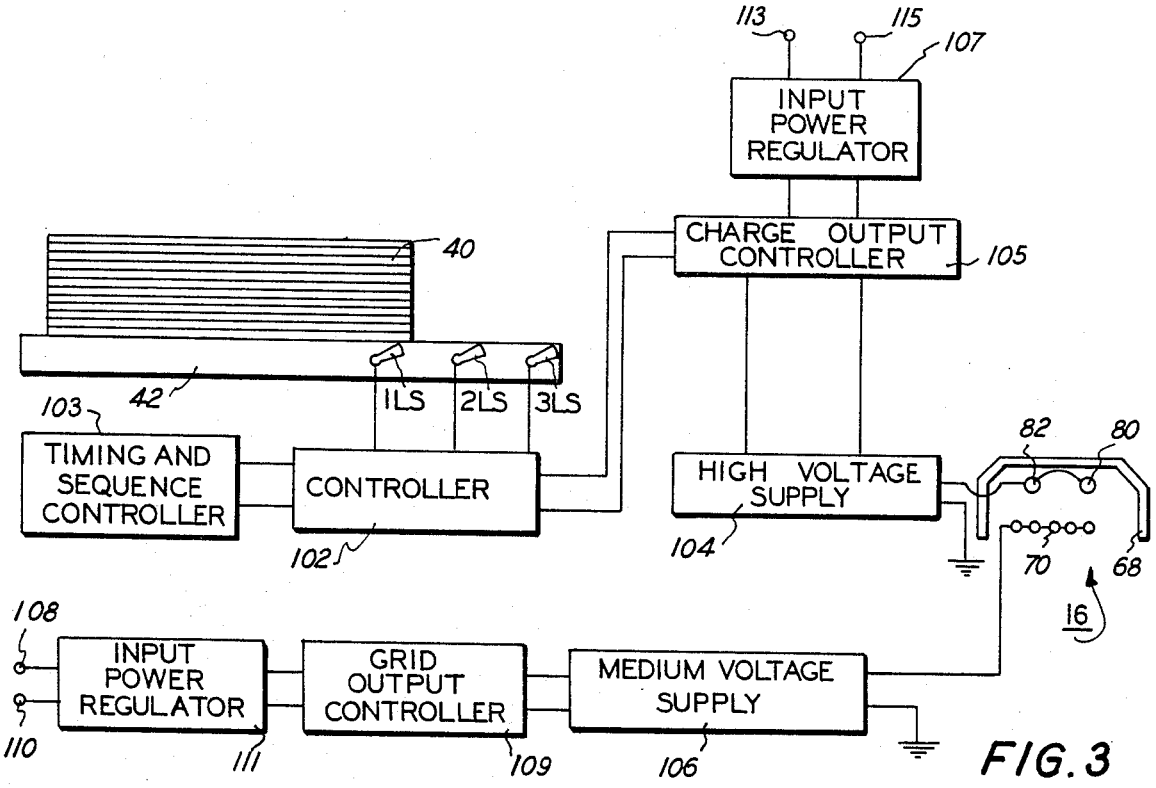
FIG. 3 is a schematic elevational view showing the sheet size regulating the corona generating apparatus.

Turning now to FIG. 3, there is shown a general schematic illustration of the regulating apparatus for corona generating device 16. As shown therein, tray 42 includes a plurality of switches. In particular, there are shown three switches associated therewith 1LS, 2LS and 3LS, respectively. Switches 1LS, 2LS and 3LS are activated by differing lengths of stack 40. By way of example, an 8½ inch long stack of paper will activate switch 1LS, while an 11 inch stack of paper will energize switches 1LS and 2LS, and a 14 inch stack of paper will energize switches 1LS, 2LS and 3LS. Switches 1LS, 2LS and 3LS in association with controller 102 and timing and sequence controller 103 are adapted to regulate the output from charge output controller 105 which, in turn, excites high voltage supply 104. Controller 102 activates controller 105 for a prescribed length of time. Controller 102 produces preferably about 24 volts therefrom for exciting charge output controller 105, which, in turn energizes high voltage power supply 104 at about 85 volts. Thus, coronode wires 80 and 82 will be energized by high voltage supply 104 for a length of time corresponding to the length of sheets of stack 40. Hence, if stack 40 is 8½ inches and switch 1LS is depressed, high voltage supply 104 will be excited for a sufficient length of time such that coronode wires 80 and 82 are excited so that the area of charge deposited on photoconductive surface 12 corresponds to the area of the 8½ inch sheets. Similarly, if switches 1LS and 2LS are depressed high voltage supply 104 will be excited a sufficient duration of time so that coronode wires 80 and 82 deposit a charge area on photoconductive surface 12 corresponding to an 11 inch sheet of paper. Finally, if switches 1LS, 2LS and 3LS are depressed, high high voltage supply 104 is excited a sufficient duration of time to excite coronode wires 80 and 82 a sufficient time to produce a charge area on photoconductive surface 12 corresponding to a 14 inch sheet of paper. It should be noted that inasmuch as drum 10 rotates and coronode wires 80 and 82 extend widthwise across the surface of drum 10, only the linear length of charge must be controlled. Thus, the width of photoconductive surface 12 corresponds to the width of the sheets in the stack. This automatically insures that the surface area charged on photoconductive surface 12 corresponds to the surface area of the sheets of stack 40. Medium voltage supply 106 excites grid wires 70 preferably at about 925 volts as hereinbefore indicated. Medium voltage supply 106 is, itself, excited by grid controller 109 at 85 volts. Input power regulator 111 is excited by a 97–127 volt source at terminals 108 and 110. Regulator 111, in turn, excites output controller with a regulated voltage of about 112 volts. Similarly, input power regulator 107 is excited by a 97–127 volt source at terminals 113 and 115. Regulator 107 excites output controller 105 with a regulated voltage of about 112 volts. While two input power regulators are shown for clarity in FIGS. 3 and 4, it will be obvious to one skilled in the art that only one input power regulator is required. A common input power regulator may be used to excite grid output controller 109 and charge output controller 105.

By way of example, if drum 10 rotates at approximately 20 revolutions per minute which corresponds to a linear velocity of approximately 10 inches per second for a drum having a diameter of about 9.6 inches. Thus, photoconductive surface 12 must be charged for 0.85 seconds to produce a charged area corresponding to an 8½ inch sheet of paper. Similarly, it must be charged for 1.1 seconds to produce a charged surface area corresponding to an 11 inch sheet of paper and 1.4 seconds to produce a charged surface area corresponding to a 14 inch sheet of paper.

Figure 4:
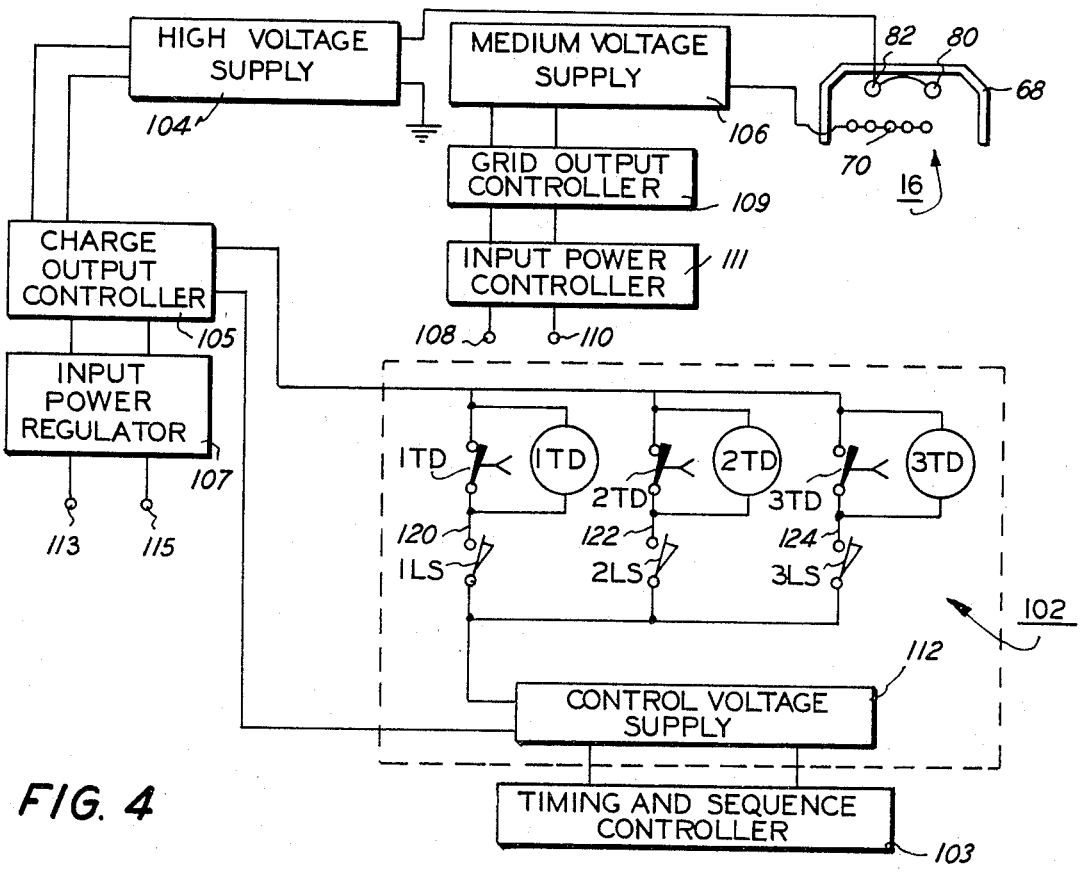
FIG. 4 illustrates an electrical circuit associated with the sheets and corona generating apparatus of FIG. 3.

Referring now to FIG. 4, the detailed arrangement of controller 102 will be described. Controller 102 includes a control power supply 112 adapted to be excited by timing and sequence controller 103. Timing and sequence controller 103 includes the timing disc mounted on the shaft of drum 10. As hereinbefore indicated, as drum 10 rotates, the slits in the periphery of the timing disc transmit light rays from a light source to a photosensor. The photosensor is activated by the light rays to generate electrical pulses. The electrical pulses from the photosensor are processed by the logic circuitry of controller 103. The output from controller 103 excites control voltage supply 112 and time delay relays 1TD, 2TD, and 3TD. Control power supply 112 is connected to charge output controller 105. The output from control power supply 112 is connected to a series of parallel electrical lines. These lines are designated by the reference 120, 122, and 124, respectively. Line 120 has switch 1LS connected in series with time delay switch 1TD. Line 122 has switch 2LS connected in series with time delay switch 2TD. Line 124 has switch 3LS connected in series with time delay switch 3TD. Time delay switches 1TD, 2TD and 3TD are normally closed. These time delay switches are adapted to remain closed for differing durations of time when excited by timing and sequence controller 103. By way of example, time delay switch 1TD is adapted to remain closed for about 0.85 seconds. Similarly, time delay switch 2TD is adapted to remain closed for about 1.1 seconds and time delay switch 3TD is adapted to remain closed for about 1.4 seconds. Thus, in operation, stack 40 disposed upon tray 42 closes switches 1LS, or switches 1LS and 2LS or switches 1LS, 2LS and 3LS. If switch 1LS is closed by stack 40, the sheets of stack 40 are short, i.e., about 8½ inches long. Thus, control power supply 112 will energize charge output controller 105 for about 0.85 seconds since time delay switch 1TD will open at that time. This will insure that the linear length of charge deposited on photoconductive surface 12 corresponds to 8½ inches. If, however, switches 1LS and 2LS are closed, control power supply 112 will energize charge output controller 105 for about 1.1 seconds inasmuch as time delay switch 2TD will remain closed for that duration of time. This insures that 11 inches of linear length are charged on photoconductive surface 12 and the charged area corresponds to the surface area of an 11 inch sheet of paper. Finally, if switches 1LS, 2LS and 3LS are all closed by a 14 inch sheet of paper, time delay switch 3TD will govern and control power supply 112 will energize charge output controller 105 for about 1.4 seconds insuring that a 14 inch linear length will be charged on photoconductive surface 12.

After the requisite linear length of charge is deposited on photoconductive 12, corona generating apparatus 16 is de-energized. De-energization of controller 105 is achieved when the time delay switches open. Opening the time delay relays disconnects control voltage supply 112 from controller 105. Controller 105 includes an operational amplifier which provides a zero output to high voltage supply 104 when voltage supply 112 is electrically disconnected therefrom. When the operational amplifier of controller 105 is de-energized and the output therefrom is zero, high voltage supply 104 is de-energized and coronode wires 80 and 82 do not emit a spray of ions therefrom. Thus, this controls the duration of length of time that high voltage power supply 104 is excited. In this manner, the charged photoconductive surface area corresponds substantially to the size of the sheet of support material disposed on tray 42.

While controller 102 has been described as comprising a plurality of time delay relays, it will be obvious to one skilled in the art that suitable logic circuitry may be employed in lieu thereof.

In recapitulation, it is apparent that the apparatus of the present invention produces a variable size charge area on the photoconductive surface. The size of the charged surface area corresponds to the size of the sheet of support material having a copy of the original document reproduced thereon. This is achieved by timing circuitry and a plurality of switches operatively associated with the sheet feeding apparatus. The switches associated with the sheet feeding apparatus indicate the length of sheet disposed therein. The timing circuitry control the time duration of charging in accordance with the length of sheet. Thus, a small sheet will have a smaller duration time of charging, while a medium sheet will have an intermediate length of charging.

It is, therefore, evident that there has been provided in accordance with the present invention, a corona generating apparatus that fully satisfies the objects, aims and advantages set forth above. While this apparatus has been described in conjunction with specific embodiments thereof, it is evident that many alternatives, modifications and variations will be apparent to those skilled in the art. Accordingly, it is intended to embrace all alternatives, modifications, and variations within the spirit and broad scope of the appended claims.

What is claimed is:

1. An apparatus for forming a charged area on an image bearing member corresponding substantially in size to the surface area of a sheet of support material arranged to have a copy of an original document reproduced thereon, including:

means for detecting the size of the surface area of the sheet of support material;

means for charging the image bearing member to a substantially uniform level; and means, responsive to said detecting means, for controlling said charging means so that the charged surface area of the image bearing member corresponds substantially in size to the surface area of the sheet of support material.

2. An apparatus as recited in claim 1, wherein said detecting means includes:

a base plate adapted to support a stack of support material thereon; and a plurality of switches operatively associated with said base plate, each of said plurality of switches being positioned in different locations on said base plate and being arranged to be energized by differing size of sheets of support material so as to indicate the surface area thereof.

3. An apparatus as recited in claim 2, wherein said controlling means includes:

a voltage source in electrical communication with said charging means;

a control voltage source electrically connected to said plurality of switches and said voltage source; and timing means, operatively associated with said control voltage source, for activating said control voltage source differing durations of time regulating the length of time said control voltage source energizes said voltage source to excite said charging means.

4. An apparatus as recited in claim 3, wherein said charging means includes:

an elongated shield extending lengthwise a distance substantially the same as the width of the image bearing member, said shield defining an open ended chamber extending along the length thereof; and at least one coronode wire extended substantially in a longitudinal direction along the length of said shield in the open ended chamber thereon.

5. An apparatus as recited in claim 4, further including means for moving the image bearing member relative to said charging means in a path of movement substantially normal to the longitudinal axis of said coronode wire.

6. An apparatus as recited in claim 4, wherein said charging means further includes:

a second coronode wire extending substantially parallel to said first mentioned coronode wire along the length of said shield in the open end of the chamber therein; and a plurality of spaced, substantially parallel longitudinally extending grid wires mounted in said shield partially enclosing the open end thereof with said first coronode wire being disposed therebeneath and said second coronode wire being disposed in the unenclosed portion of the chamber of said shield.

7. An apparatus as recited in claim 6, wherein said charging means further includes means for cleaning said coronode wires and the interior surface of said grid wires opposed from said coronode wires.

8. An electrophotographic printing machine of the type employing a photoconductive member to reproduce a copy of an original document on a sheet of support material, wherein the improvement includes:

means for detecting the size of the surface area of the sheet of support material;

means for charging the photoconductive member to a substantially uniform level; and means, responsive to said detecting means, for controlling said charging means so that the charged surface of the photoconductive member corresponds substantially in size to the surface area of the sheet of support material.

9. A printing machine as recited in claim 8, wherein said detecting means includes:

a base plate adpated to support a stack of sheets of support material thereon; and a plurality of switches operatively associated with said base plate, each of said plurality of switches being positioned in different locations on said base plate and being arranged to be energized by differing size sheets of support material so as to indicate the surface area thereof.

10. A printing machine as recited in claim 9, wherein said controlling means includes;

a voltage source in electrical communication with said charging means;

a control voltage source electrically connected to said plurality of switches and said voltage source; and timing means, operatively associated with said control voltage source, for activating said control voltage source differing durations of time regulating the length of time said control voltage source energizes said voltage source to excite said charging means.

11. A printing machine as recited in claim 10, wherein said charging means includes:

an elongated shield extending lengthwise a distance substantially the same as the width of the photoconductive member, said shield defining an open ended chamber extending along the length thereof; and at least one coronode wire extending substantially in a longitudinal direction along the length of said shield.

12. A printing machine as recited in claim 11, further including means for moving the photoconductive member relative to said charging means in a path of movement substantially normal to the longitudinal axis of said coronode wire.

13. A printing machine as recited in claim 11, wherein said charging means further includes:

a second coronode wire extending substantially parallel to said first mentioned coronode wire along the length of said shield in the open end of the chamber therein; and a plurality of spaced substantially parallel longitudinally extending grid wires mounted in said shield partially enclosing the open end thereof with said first coronode wire being disposed therebeneath and said second coronode wire being disposed in the unenclosed portion of the chamber of said shield.

14. A printing machine as recited in claim 13, wherein said charging means further includes means for cleaning said coronode wires and the interior surface of said grid wires opposed from said coronode wires.

15. A method of copying an original document on a sheet of support material, including the steps of:

charging a photoconductive member to a substantially uniform potential;

controlling said step of charging so that the surface area charged on the photoconductive member corresponds substantially in size to the surface area of the sheet of support material; and exposing the charged surface area of the photoconductive member to a light image of the original document recording an electrostatic latent image of the original document thereon.

16. A method as recited in claim 15, further including the step of moving the photoconductive member relative to a substantially stationary charging device extending across the width thereof.

17. A method as recited in claim 16, wherein said step of controlling includes the steps of:

detecting the surface area of the sheet of support material; and regulating the duration of time that the charging device charges the photoconductive member as the photoconductive member passes therebeneath so that the charged surface area therein corresponds substantially in size to that of the sheet of support material.

18. A method as recited in claim 17, further including the steps of:

developing the electrostatic latent image with toner particles to form a toner powder image on the photoconductive member;

transferring the toner powder image from the photoconductive member to a sheet of support material; and affixing substantially permanently the toner powder image to the sheet of support material.

19. A method as recited in claim 18, further including the step of repeating said steps of charging, controlling, exposing, developing and transferring to form a multi-color toner powder image on the sheet of support material prior to said step of affixing.

* * * * *